US005809952A

United States Patent [19]

Ono et al.

[11] Patent Number: 5,809,952

[45] Date of Patent: Sep. 22, 1998

[54] VALVE OPENING SYSTEM OF INTERNAL COMBUSTION ENGINE

[75] Inventors: Takashi Ono, Kawasaki; Fumio Akikawa, Tokyo; Akira Matsumoto, Kanagawa; Masahiko Takeuchi, Kawasaki, all of Japan

[73] Assignee: Mitsubishi Jidosha Kogyo Kabushiki Kaisha, Tokyo, Japan

[21] Appl. No.: 773,571

[22] Filed: Dec. 27, 1996

[30] Foreign Application Priority Data

Dec. 28, 1995 [JP] Japan ..... 7-343791

[51] Int. Cl.[6] ..... F01L 13/00

[52] U.S. Cl. ..... 123/90.16; 123/182.1; 123/321

[58] Field of Search ..... 123/90.15, 90.16, 123/90.22, 90.23, 90.27, 90.39, 182.1, 321

[56] References Cited

U.S. PATENT DOCUMENTS

| | | | |
|---|---|---|---|
| 4,473,047 | 9/1984 | Jakuba et al. | 123/323 |
| 5,186,128 | 2/1993 | Murata et al. | 123/90.16 |
| 5,207,193 | 5/1993 | Sugimoto et al. | 123/90.16 |
| 5,357,926 | 10/1994 | Hu et al. | 123/321 |
| 5,379,737 | 1/1995 | Hu | 123/322 |
| 5,388,552 | 2/1995 | Sugimoto et al. | 123/90.16 |
| 5,441,020 | 8/1995 | Murata et al. | 123/90.16 |

FOREIGN PATENT DOCUMENTS 533684 2/1993 Japan .

*Primary Examiner*—Weilun Lo

[57] ABSTRACT

A valve mechanism of an internal combustion engine is provided which includes a camshaft that produces drive force for opening and closing a plurality of shut-off valves provided on a combustion chamber. This valve mechanism has a rocker shaft supported at its opposite ends by a pair of rocker shaft supports onto a cylinder head, and first and second rocker arms that are supported by the rocker shaft between the rocker shaft supports such that these rocker arms are movable with respect to each other. The first rocker arm has at one end portion thereof a point of force that receives the drive force from the camshaft, and the second rocker arm has a point of application for driving part of the shut-off valves, at one end portion that is opposite to the point of force of the first rocker arm with respect to an axis of the rocker shaft. The point of application of the second rocker arm is located opposite to the point of force of the first rocker arm, such that an imaginary plane, which includes a middle point of the rocker shaft between the rocker shaft supports and orthogonal to the axis of the rocker shaft, is interposed between the point of application and the point of force.

12 Claims, 13 Drawing Sheets

POINT OF APPLICATION "B"
2
24
22A
4
6
52
8
24
50
42
8a
6a
4a
2a
POINT OF FORCE "A"
2/L
L

POINT OF APPLICATION "B"
22
2
2a
32 EXHAUST CAM
ROTATING DIRECTION 42
8
46
40
8a
38
POINT OF FORCE "A"
ROTATING DIRECTION

EXHAUST LIFT
BDC
TDC
BDC
TDC
BDC
AUXILIARY ENGINE BRAKE ROCKER ARM DOES NOT LIFT EXHAUST VALVE BECAUSE PIN 42 IS NOT LIFTED

NORMAL DRIVING CONDITION

AUXILIARY ENGINE BRAKE OPERATION CONDITION

VALVE OPENING SYSTEM OF INTERNAL COMBUSTION ENGINE

BACKGROUND OF THE INVENTION

The present invention relates to a valve mechanism of an internal combustion engine wherein intake and exhaust valves are opened and closed by means of rocker arms.

Valve mechanisms of internal combustion engines, such as those of OHV (overhead valve) type or OHC (overhead camshaft) type, have been known in the art and widely applied.

FIGS. 12(*a*), 12(*b*) are schematic views showing a known example of an OHC type valve mechanism adapted to open and close intake and exhaust valves by means of rocker arms.

In this OHC type valve mechanism, rocker arms 2, 6 are supported by a rocker shaft 22 about its axis, and a camshaft 10 is disposed in parallel with the axis 22A of the rocker shaft 22, as shown in FIGS. 12(*a*), 12(*b*). The camshaft 10 is driven by rotary drive force of a crankshaft (not shown) of the engine, and the rocker arms 2, 6, are respectively driven by cams 32, 36 provided on the camshaft 10.

When the drive force of the cam 32, 36 is applied to point "A" of force of one end portion of the rocker arm 2, 6, the rocker arm 2, 6 swings or rocks about the rocker shaft 22, and thus pushes a corresponding valve stem at point "B" of application located at the other end of the rocker arm 2, 6 so as to open the intake or exhaust valve. The rocker arms 2, 6 are provided with respective rollers (bearings) 2*a*, 6*b*, as shown in FIG. 12(*a*).

The rocker shaft 22 is normally supported by two rocker shaft supports 24 provided on the left- and right-hand side thereof with respect to each of cylinders of the engine. Where the points "A" of force and points "B" of action of the rocker arms 2, 6 are closer to one of the two rocker shaft supports 24 than to the other as shown in FIG. 12(*a*), however, the burden on the one rocker shaft support 24 to which the rocker arms 2, 6 are located to be closer becomes larger than that on the other shaft support 24. In this condition, large force applied to the rocker arms 2, 6 would result in an excessive burden on the above-indicated one rocker shaft support 24.

Namely, when the rocker arm 2 is located closer to the left rocker shaft support 24 than to the right rocker shaft support 24, as shown in FIG. 12(*a*), the force applied to the left rocker shaft support 24 is equal to $[(L-a)/L]\cdot P$ where "P" is force applied to the rocker shaft 22, "L" is a distance between the two rocker shaft supports 24, and "a" is a distance from the left rocker shaft support 24 to the center of the rocker arm 2.

Thus, the burden on the left rocker shaft support 24 is increased as the distance "a" from the left rocker shaft support 24 to the center of the rocker arm 2 decreases, namely, as the rocker arm 2 becomes closer to the left rocker shaft support 24. In such a case where the rocker arm is offset with respect to the middle point between the two rocker shaft supports, one of the rocker shafts to which the rocker arm is closer needs to be given an increased mechanical strength, which may result in increases in the weight and cost of the valve mechanism.

SUMMARY OF THE INVENTION

The present invention has been developed in the light of the above problems. It is, therefore, an object of the present invention to provide a valve operating mechanism of an internal combustion engine which has a plurality of shut-off valves for communicating a combustion chamber with an exterior of the combustion chamber and disconnecting the combustion chamber from the exterior, and a camshaft that produces drive force for opening and closing the valves, wherein the unbalance of the force applied from rocker arms to rocker shaft supports is reduced, and preferably the force is evenly distributed to the supports, thereby avoiding increases in the weight and cost of the rocker shaft supports.

It is another object of the invention to provide the valve operating mechanism of the internal combustion engine as described above which can be switched to a valve drive mode in which exhaust valves are opened at a point of compression stroke of the engine near its top dead center to release a part of compressed air, so that the engine is negatively operated to apply an auxiliary engine brake to the vehicle.

It is a further object of the invention to provide the valve operating mechanism of the internal combustion engine which can be switched to the valve drive mode as described above, wherein dimensions of its components can be easily controlled during manufacturing thereof.

To attain the above objects, there is provided a valve operating mechanism of an internal combustion engine which valve mechanism comprises: a rocker shaft supported at opposite end portions thereof by a pair of rocker shaft supports onto a cylinder head; a first rocker arm supported by the rocker shaft and located between the rocker shaft supports, the first rocker arm having at one end portion thereof a point of force that receives drive force from a camshaft; and a second rocker arm supported by the rocker shaft at a position offset from said first rocker arm in a direction of an axis of said rocker shaft, the second rocker arm being movable with the first rocker arm and having at an end portion thereof a point of application for driving at least one poppet or shut-off valve, the end portion being located opposite to the point of force of the first rocker arm with respect to the axis of the rocker shaft such that an imaginary plane, which includes a middle point of the rocker shaft between the rocker shaft supports and orthogonal to the axis of the rocker shaft, is interposed between the point of application and the point of force.

In the valve mechanism described above, a virtual line connecting the point of force of the first rocker arm with the point of application of the second rocker arm preferably intersects with the axis of the rocker shaft at a substantially middle point of the rocker shaft between the rocker shaft supports.

In one preferred form of the invention, the valve operating mechanism of the present invention further includes a third rocker arm supported by the rocker shaft between the first rocker arm and the second rocker arm, the third rocker arm having a point of force at one end portion thereof which receives the drive force from the camshaft, and a point of application at the other end portion thereof which drives at least one another shut-off valve. In this valve operating mechanism, the third rocker arm is preferably supported by the rocker shaft at the substantially middle point of the rocker shaft between the rocker shaft supports.

In the valve operating mechanism described above, the at least one shut-off valve driven by the second rocker arm is an exhaust valve, and at least one another shut-off intake valve driven by the third rocker arm is an intake valve. Further, a fourth rocker arm may be provided between the first and second rocker arms for driving a fuel injection valve.

In another preferred form of the invention, the second rocker arm is moved linked with the first rocker arm through a linking mechanism engageable with the first rocker arm, and the second rocker arm has a point of force to which the drive force is applied from the camshaft in a different timing from that in which the point of force of the first rocker arm receives the drive force, the point of force of the second rocker arm being located in an end portion thereof opposite to the end portion in which the point of application is located. In this valve mechanism, the shut-off valves may include at least one exhaust valve driven by the second rocker arm, and the first rocker arm may be driven by the camshaft to open the at least one exhaust valve during a compression stroke at a point close to a top dead center.

In the valve operating mechanism described above, the rocker shaft may be rotatably supported by the pair of rocker shaft supports, and one of the first and second rocker arms may be pivoted as a unit with the rocker shaft while the other is rotatably supported by the rocker shaft. The linking mechanism may have an engaging pin that is movably received in a hole formed in the rocker shaft, and an engaging hole that is formed in the other of the first and second rocker arms such that the engaging pin is selectively engageable with the engaging hole. The valve operating mechanism may further include at least one third rocker arm rotatably supported by the rocker shaft between the first and second rocker arms, the rocker shaft having a first portion on which the other of the first and second rocker arms is rotatably supported, and a second portion on which the at least one third rocker arm is rotatably supported, the first portion of the rocker shaft having a smaller diameter than the second portion, the first and second portions defining a boundary portion with an end face of the second portion which determines a position of the other of the first and second rocker arm in a direction of the axis of the rocker shaft.

According to another aspect of the present invention, there is provided a valve operating mechanism of an internal combustion engine comprising: a rocker shaft rotatably supported by a cylinder head; a first rocker arm supported by the rocker shaft and having a point of force that receives the drive force from the camshaft; a second rocker arm supported by the rocker shaft at a position offset from said first rocker arm in a direction of an axis of said rocker shaft, the second rocker arm being movable with the first rocker arm through a linking mechanism that is engageable with the first rocker arm, the second rocker arm having a point of application that drives at least one shut-off valve, at an end portion thereof opposite to the point of force of the first rocker arm with respect to the axis of the rocker shaft; and a third rocker arm supported by the rocker shaft to be located between the first and second rocker arms, the third rocker arm having a point of force that receives the drive force from the camshaft at one end portion thereof, and a point of application that drives at least one another shut-off valve at the other end portion thereof. In this valve mechanism, the second rocker arm has a point of force at an end portion thereof opposite the end portion having the point of application, the point of force of the second rocker arm receiving the drive force from the cam shaft in a different timing from that in which the point of force of the first rocker arm receives the drive force, and one of the first rocker arm and the second rocker arm is pivoted as a unit with the camshaft, while the other of the first and second rocker arms is rotatably supported by the rocker shaft, the linking mechanism including an engaging pin that is movably received in a hole formed in the rocker shaft, and an engaging hole that is formed in the other of the first and second rocker arms such that the engaging pin is engageable with the engaging hole. Further, the rocker shaft has a first portion on which the other of the first and second rocker arms is rotatably supported, and a second portion on which the third rocker arm is rotatably supported, the first portion having a smaller diameter than the second portion, the first and second portions defining a boundary portion with an end face of the second portion which determines a position of the other of the first and second rocker arms in a direction of the axis of the rocker shaft.

In the valve mechanism of the internal combustion engine constructed as described above according to the present invention, the unbalance of the force applied to the pair of rocker shaft supports upon driving of the first and second rocker arms can be reduced, and the force from these rocker arms can be uniformly or evenly distributed to the two rocker shaft supports. This avoids an increase in the size of one of the rocker shaft supports as required in the known valve mechanism. Thus, the valve mechanism having a sufficiently high mechanical strength can be achieved without incurring increases in the weight and manufacturing cost.

The exhaust valves can be driven by the first rocker arm such that the valves are opened at a point of compression stroke near its top dead center so as to release a part of compressed air, whereby the internal combustion engine performs a negative work. Thus, an engine brake can be applied by switching the valve mechanism from a normal positive power mode to the above mode for applying the engine brake, without providing another exhaust valve for releasing the compressed air upon application of the engine brake.

Further, where the rocker shaft has a large-diameter portion that supports at least one third rocker arm, and a small-diameter portion that supports the first or second rocker arm, the position of the first or second rocker arm in the axial direction of the rocker shaft can be determined by the end face of the large-diameter portion at the boundary portion between the large-diameter portion and the small-diameter portion. In this case, the dimensions or position of the first or second rocker arm can be controlled with high accuracy, without being influenced by dimensional errors of the third rocker arm(s). This ensures smooth and reliable engagement between the engaging pin and engaging hole of the linking mechanism.

DETAILED DESCRIPTION OF THE PREFERRED EMBODIMENTS

Referring to FIG. 1 through FIG. 9, a valve mechanism of an internal combustion engine of the first embodiment of the present invention will be described in detail.

Figure 5:
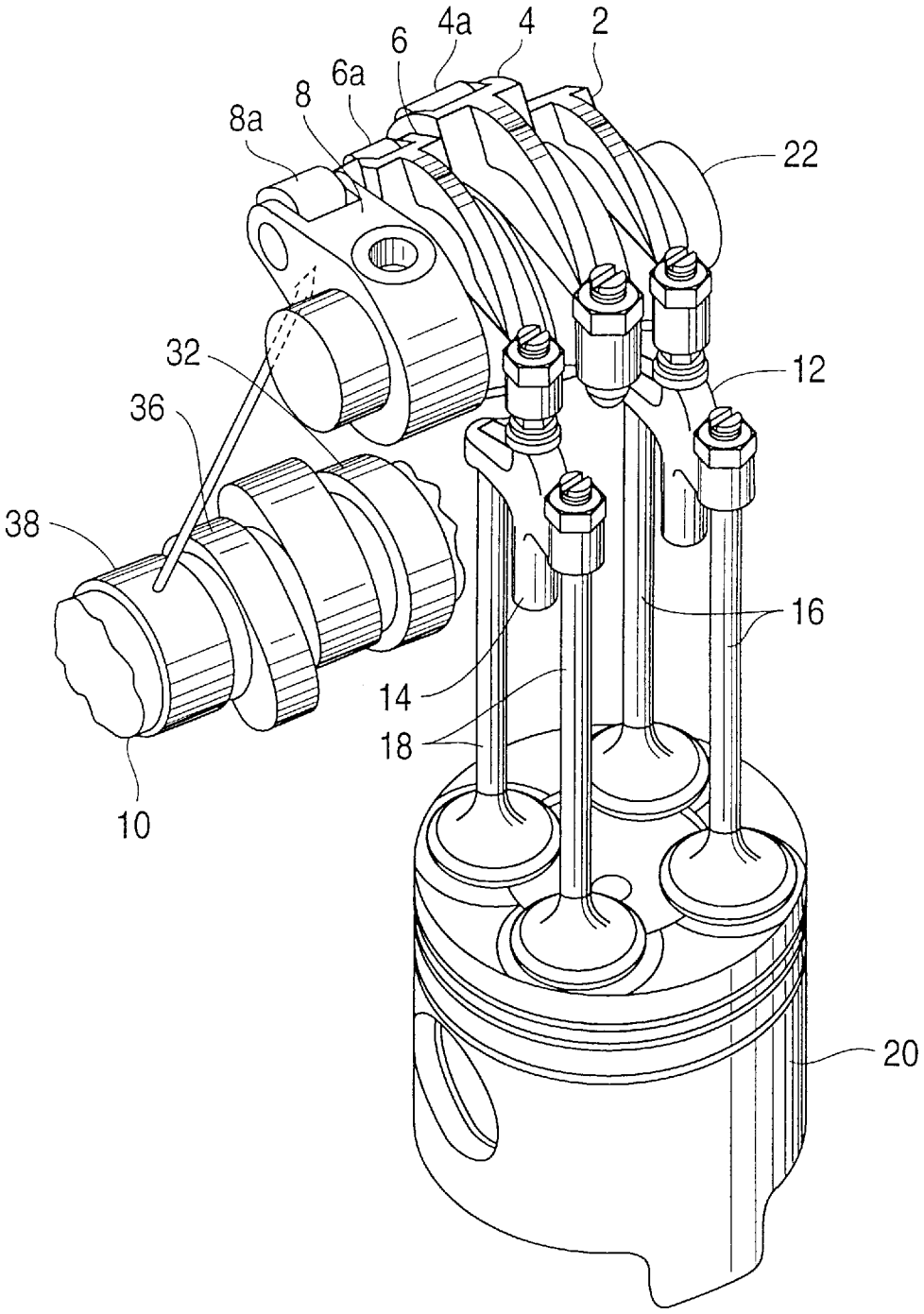
FIG. 5 is a perspective view schematically showing the whole construction of the valve mechanism of the internal combustion engine of the first embodiment of the present invention.
Figure 6:
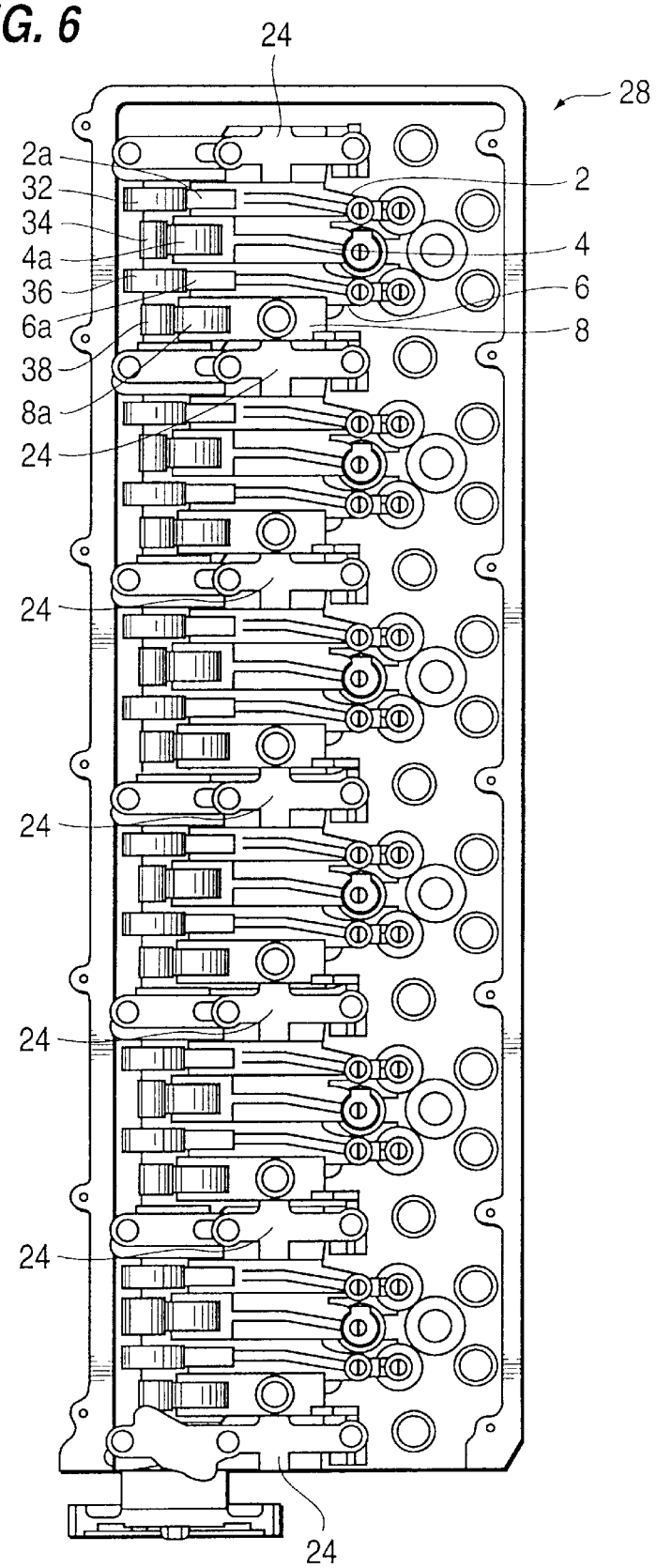
FIG. 6 is a top plan view schematically showing the valve mechanism of the internal combustion engine of the first embodiment of the present invention.
Figure 7:
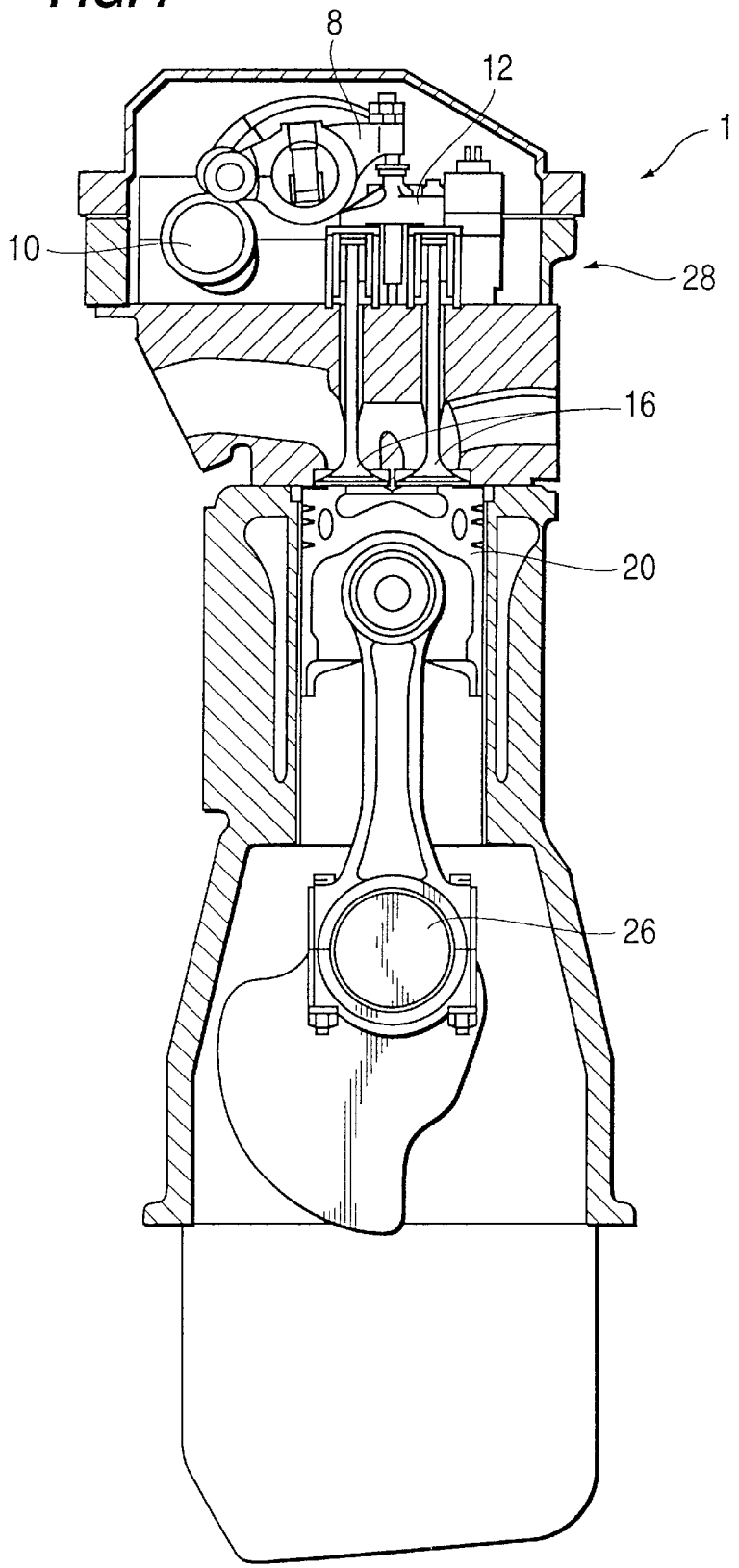
FIG. 7 is a cross sectional view schematically showing the engine equipped with the valve mechanism of the first embodiment of the invention.

Of these figures, FIGS. 5–7 illustrate the construction of the engine in which the present valve mechanism is employed. More specifically, FIG. 5 is a perspective view showing the internal construction of four-cycle diesel engine (hereinafter referred simply as "engine") 1, and FIG. 6 is a top plan view schematically showing cylinder head 28 of the engine 1, while FIG. 7 is a cross sectional view of the cylinder head 28.

Initially, the basic construction of the engine 1 will be briefly described. As shown in FIGS. 5–7, the engine 1 is provided with an OHC-type (overhead camshaft) valve mechanism, and consists of a four-valve type engine with two intake valves and two exhaust valves.

In the cylinder head 28 of the engine 1, there is provided a camshaft 10 that is rotated or driven by the rotary driving force of a crankshaft 26 shown in FIG. 7.

Intake cam 36 and exhaust cam 32 formed with cam profiles suitable for normal operations of the engine 1 are mounted on the camshaft 10.

The valve mechanism of the engine 1 also includes a rocker shaft 22 for supporting various rocker arms which will be described later. The rocker shaft 22 is provided with respect to each of six cylinders of the engine 1 such that the shafts 22 for the respective cylinders are disposed coaxially with each other. The opposite end portions of the rocker shaft 22 are rotatably supported by respective rocker shaft supports 24 shown in FIG. 6.

FIG. 6 shows cylinder head of the engine 1 in the form of straight six-cylinder engine. While main elements of only one cylinder are denoted by reference numerals in this figure, it is to be understood that the valve mechanism is constructed identically with respect to all of the six cylinders of the engine 1.

Turning to FIG. 5, two intake shut-off or poppet valves 18 and two shut-off or poppet exhaust valves 16 are mounted above a piston 20, and valve bridges 14, 12 are disposed above the intake and exhaust valves 18, 16, respectively. The two intake valves 18, 18 are concurrently opened and closed by the intake valve bridge 14, and the two exhaust valves 16, 16 are concurrently opened and closed by the exhaust valve bridge 12.

In FIG. 5, the cam shaft 10 is illustrated separately from the rocker shaft 22 for the sake of easy understanding of the valve mechanism of the engine 1.

On the rocker shaft 22, there are mounted an exhaust rocker arm 2 as a second rocker arm for driving the exhaust valves, a rocker arm 4 for driving a unit injector, an intake rocker arm 6 as a third rocker arm for driving the intake valves, and a rocker arm 8 as a first rocker arm for performing compression release auxiliary engine braking.

The camshaft 10 is provided with an auxiliary engine brake cam 38 for driving the auxiliary engine brake rocker arm 8, and a unit injector cam 34 for driving the unit injector rocker arm 5, as well as the intake cam 36 and exhaust cam 38 as described above.

The rocker arms 2, 4, 6, 8 are provided, at their respective end portions on the side of the cam shaft 10, with rollers (bearings) 2*a*, 4*a*, 6*a*, 8*a*, respectively, that are constantly in contact with the cams 32, 34, 36, 38 to reduce friction between these cams 32, 34, 36, 38 and the rocker arms 2, 4, 6, 8.

The unit injector rocker arm 4 is a rocker arm for driving a unit injector (not shown), and is suitably operated to inject a fuel into a combustion chamber in a predetermined timing.

The above-indicated exhaust rocker arm 2 is formed integrally with the rocker shaft 22, so that the rocker shaft 22 itself pivots or rotates along with the exhaust rocker arm 2.

The unit injector rocker arm 4 and intake rocker arm 6 are supported by the rocker shaft 22 such that these arms 4, 6 can be respectively rotated relative to the shaft 22. In this arrangement, the rocker arms 2, 4, 6 are operated independently of each other, without being influenced by rotary motion of the other rocker arms.

The auxiliary engine brake rocker arm 8 serves to apply a compression release auxiliary engine brake (hereinafter simply referred to as auxiliary engine brake) as one type of engine braking, and is rotatably supported by the rocker shaft 22 just as the injector rocker arm 4 and intake rocker arm 6.

To apply the auxiliary engine brake, the valve mechanism is controlled to operate the auxiliary engine braking rocker arm 8 as a unit with the exhaust rocker arm 2, so as to open the exhaust valves 16 at an appropriate time that is outside exhaust strokes.

The above-indicated compression release auxiliary engine brake may be applied in the following manner. Namely, the intake air is introduced into each cylinder during an intake stroke by normally opening the intake valves 18, and the intake air within the cylinder is then compressed during a compression stroke while both the intake valves 18 and the exhaust valves 16 are closed, as in the case where the engine is in positive power mode.

The fuel injection is not performed even when the piston reaches near the top dead center at the end of the compression stroke, and the exhaust valves 16 are opened just before a combustion and expansion stroke takes place so that the compressed air is discharged into an exhaust port through the exhaust valves 16. As a result, the repulsive force of the intake air that has been compressed during the compression stroke is not exerted on the piston 20, namely, the force pushing down the piston 20 is removed or eliminated.

After discharging the compressed air, the exhaust valves 16 are closed so that the inside of the cylinder is held in an air-tight condition during the expansion stroke. As a result, the force preventing the piston 20 from descending is produced whereby an engine brake is applied.

When the piston 20 then reaches near the bottom dead center and the expansion stroke is followed by an exhaust stroke, the exhaust valves 16 are opened as in the normal operation or positive power mode, and the pressure inside the cylinder is lowered down approximately to the atmospheric pressure so that the force pulling the piston 20 up is removed. Thereafter, the intake stroke starts again when the piston 20 reaches near the top dead center.

In the manner as described above, the effect of the engine braking is significantly increased by successively applying the braking force to the piston 20 during the compression and expansion strokes. In other words, with the engine 1 performing the pumping action as a negative work, the kinetic energy of the vehicle is absorbed and converted into the braking force.

To apply the auxiliary engine brake in the above manner, the exhaust valves 16 need to be operated in a timing that is different from the timing in which the exhaust valves 16 are normally operated in the positive power mode of the engine. To this end, the engine 1 is equipped with the auxiliary engine brake rocker arm 8 for opening and closing the exhaust valves 16 in the timing different from the normal timing, and the auxiliary engine brake cam 38 having a cam profile suitable for applying the engine auxiliary brake.

More specifically, the auxiliary engine brake cam 38 is formed with the cam profile that swings or rocks the auxiliary engine brake rocker arm 8 to open the exhaust valves 16 when the piston 20 reaches near the top dead center at the end of the compression stroke so as to open the exhaust valves 16, thereby applying the auxiliary engine brake.

Namely, the exhaust valves 16 are driven only by the exhaust rocker arm 2 while the engine 1 is in the normal operation or positive power mode, and are driven by both the exhaust rocker arm 2 and the auxiliary engine brake rocker arm 8 when the auxiliary engine brake is to be applied.

The valve mechanism of the engine 1 is therefore provided with a switching mechanism (or rocker arm engaging mechanism) 30 adapted to switch the valve mechanism between a linked mode in which the auxiliary engine brake rocker arm 8 operates as a unit with the exhaust rocker arm 2, and a non-linked mode in which the auxiliary engine brake rocker arm 8 is dissociated from the exhaust rocker arm 2 so that the exhaust rocker arm 2 operates as a single element, independently of the rocker arm 8.

Figure 4A:
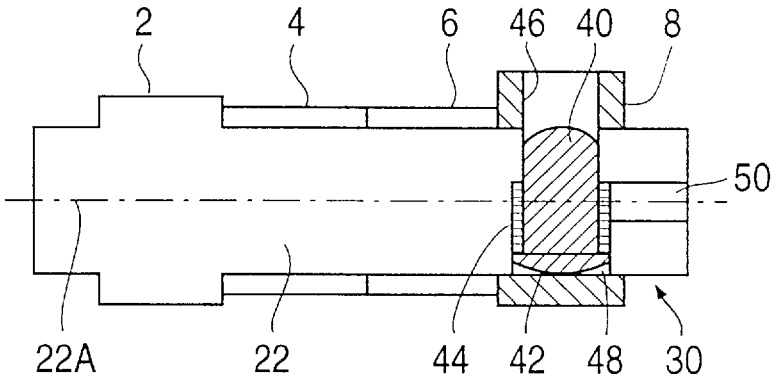
FIGS. 4(*a*) and 4(*b*) are schematic views for explaining the operation of the auxiliary engine brake rocker arm of the valve mechanism of the internal combustion engine of the first embodiment of the invention, wherein FIG. 4(*a*) shows the operating state of the valve mechanism when the engine is in positive power mode and FIG. 4(*b*) shows the operating state when an auxiliary engine brake is applied.
Figure 4B:
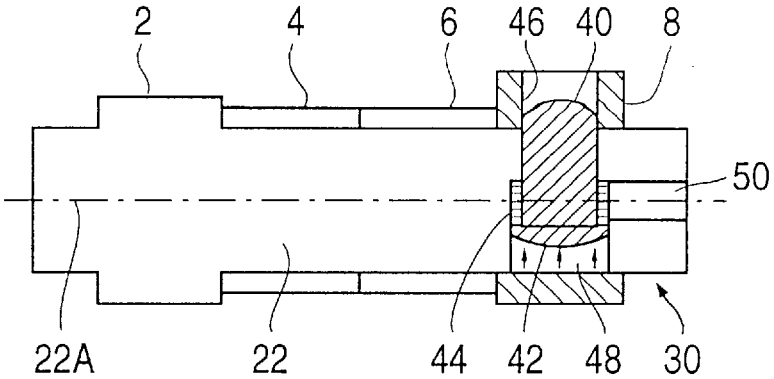

The above-described switching mechanism 30 is constructed similarly to a hydraulic piston mechanism disclosed in U.S. Pat. No. 5,186,128, for example. As shown in FIGS. 4(*a*) and 4(*b*), the switching mechanism 30 has a hole 40 formed in a diametrical direction of the rocker shaft 22, an engaging pin 42 that can move upward and downward in FIGS. 4(*a*), 4(*b*) within the hole 40, and a return spring 44 provided substantially coaxially with the engaging pin 42. The engaging pin 42 is biased downwardly as viewed in FIGS. 4(*a*), 4(*b*), due to the bias force of the return spring 44.

The auxiliary engine brake rocker arm 8 is formed at an appropriate portion with an engaging hole 46 for receiving the upper end portion of the engaging pin 42.

On the other hand, a space 48 is formed between the above-indicated hole 40 and the lower end of the engaging pin 42. The engine 1 is equipped with a hydraulic supply system (not shown) for supplying hydraulic fluid having a suitable pressure, and the rocker shaft 22 is formed with a hydraulic fluid supply path 50 through which the hydraulic fluid is supplied from the hydraulic supply system into the above-indicated space 48.

Once the hydraulic fluid is supplied to this space 48, the engaging pin 42 is moved upwards against the bias force of the return spring 44. In this case, when the engaging hole 46 of the auxiliary engine brake rocker arm 8 is aligned with the hole 40 of the rocker shaft 22, the upper end (distal end) of the engaging pin 42 engages the engaging hole 46 so that the rocker arm 8 and rocker shaft 22 are connected with each other, whereby the valve mechanism is placed in the linked mode in which the auxiliary engine brake rocker arm 8 operates as a unit with the exhaust rocker arm 2.

If the supply of the hydraulic fluid is interrupted or stopped, the engaging pin 42 moves downward due to the bias force of the return spring 44, as shown in FIG. 4(*a*), and the engaging pin 42 is disengaged from the engaging hole 46. In this case, the valve mechanism is placed in the non-linked mode in which the rocker arm 8 is separated from the rocker shaft 22 and dissociated from the exhaust rocker arm 2.

In the positive power mode of the engine 1, the auxiliary engine brake rocker arm 8 is separated or dissociated from the rocker shaft 22, so that the exhaust valves 16 are opened and closed in the normal exhaust timing due to the drive force from the exhaust rocker shaft 2.

When the auxiliary engine brake is to be applied, the switching mechanism 30 is controlled so as to operate the auxiliary engine brake rocker arm 8 as a unit with the rocker shaft 22, so that the exhaust valves 16 are opened even when the piston 20 reaches near the top dead center at the end of the compression stroke.

Figures 1A, 1B, 1C, 1D:
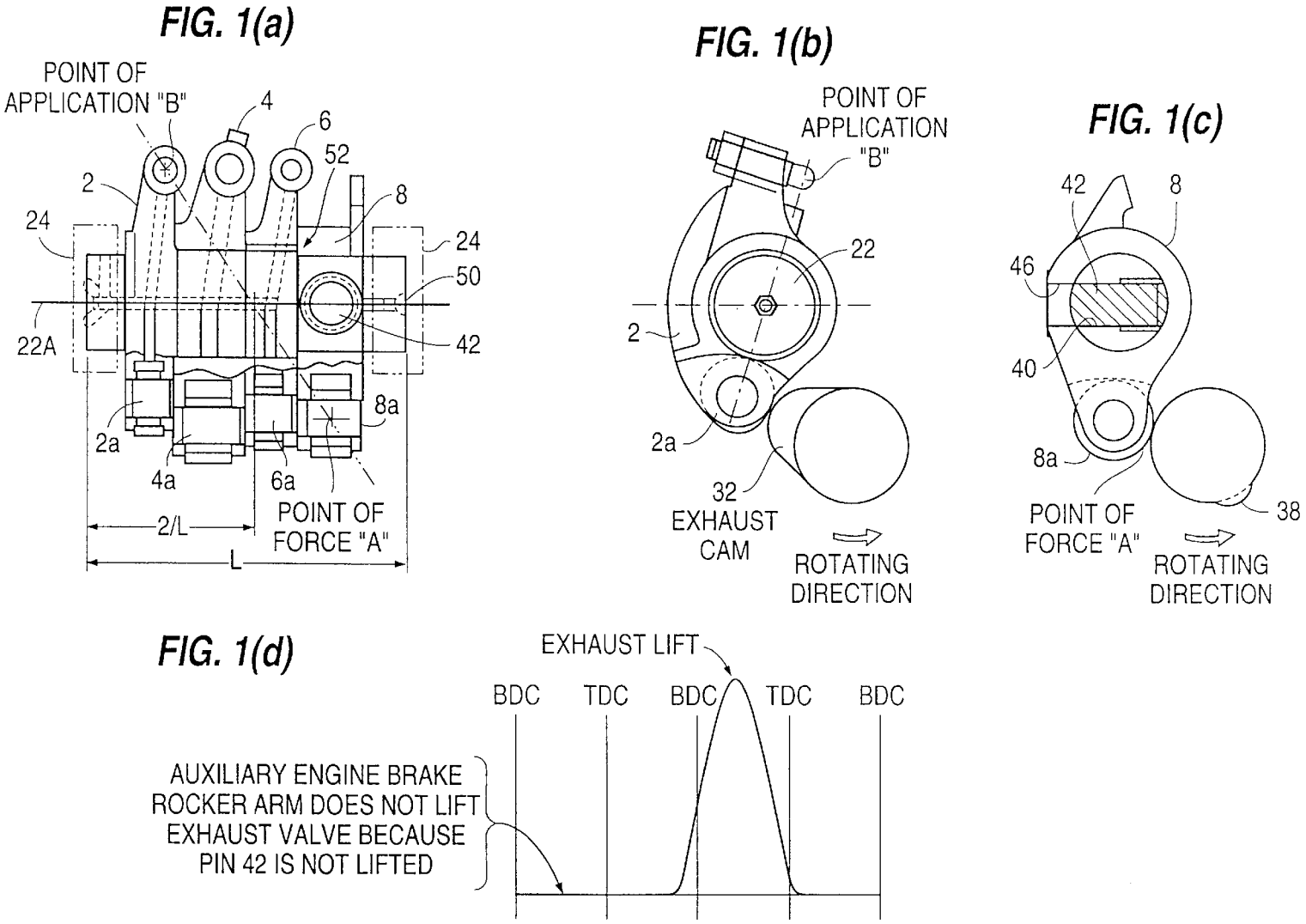
FIG. 1(*a*) is a top plan view showing a valve mechanism of an internal combustion engine of the first embodiment of the present invention, FIG. 1(*b*) is a cross sectional view schematically showing an exhaust rocker arm and its surroundings, FIG. 1(*c*) is a cross sectional view schematically showing an auxiliary engine brake rocker arm and its surroundings, and FIG. 1(*d*) is a timing chart showing a valve lift characteristic of the exhaust rocker arm.
Figure 2A:
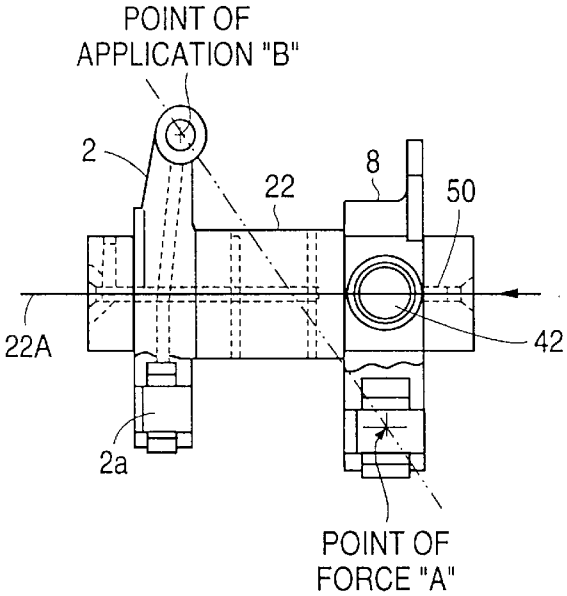
FIG. 2(*a*) is a top plan view showing the valve mechanism of the internal combustion engine of the first embodiment of the present invention, FIG. 2(*b*) is a cross sectional view schematically showing the exhaust rocker arm and its surroundings, FIG. 2(*c*) is a cross sectional view schematically showing the auxiliary engine brake rocker arm and its surroundings, and FIG. 2(*d*) is a timing chart showing a valve lift characteristic of the exhaust rocker arm.
Figure 2B:
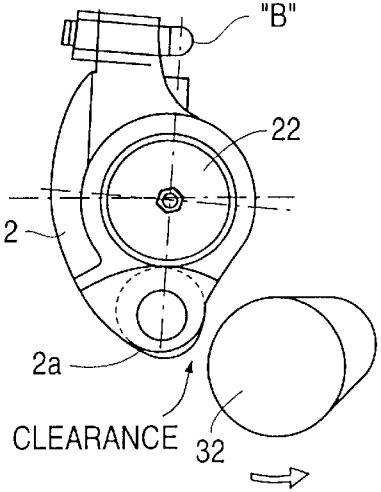
Figure 2C:
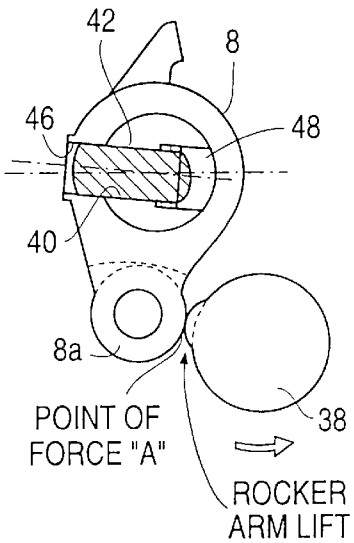
Figure 2D:
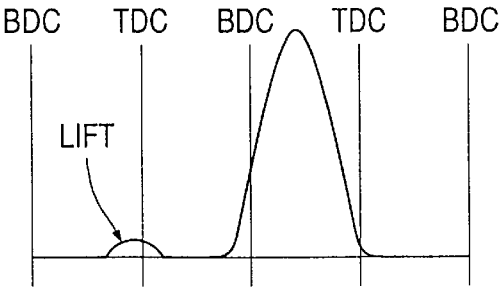
Figure 3A:
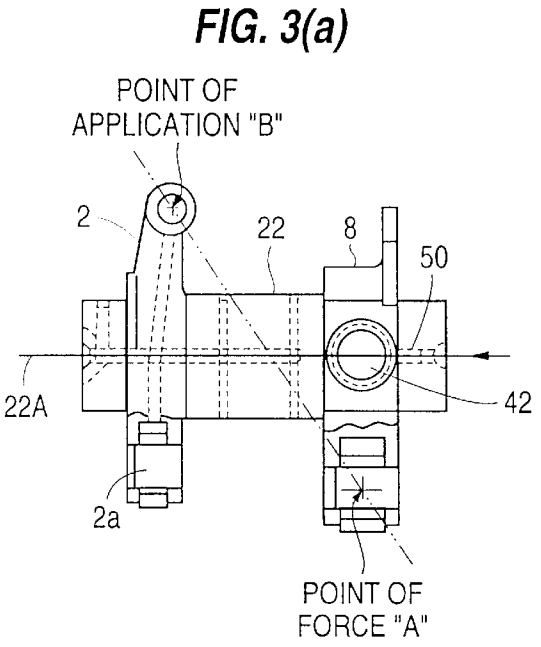
FIG. 3(*a*) is a top plan view showing the valve mechanism of the internal combustion engine of the first embodiment of the present invention, FIG. 3(*b*) is a cross sectional view schematically showing the exhaust rocker arm and its surroundings, FIG. 3(*c*) is a cross sectional view schematically showing the auxiliary engine brake rocker arm and its surroundings, and FIG. 3(*d*) is a timing chart showing a valve lift characteristic of the exhaust rocker arm.
Figure 3B:
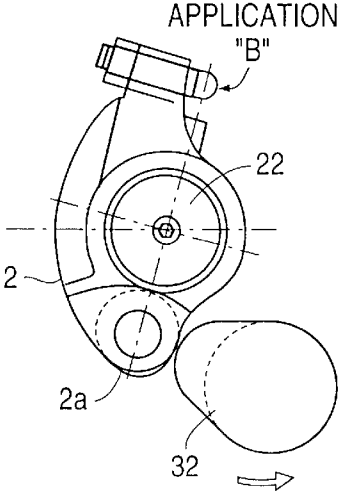
Figure 3C:
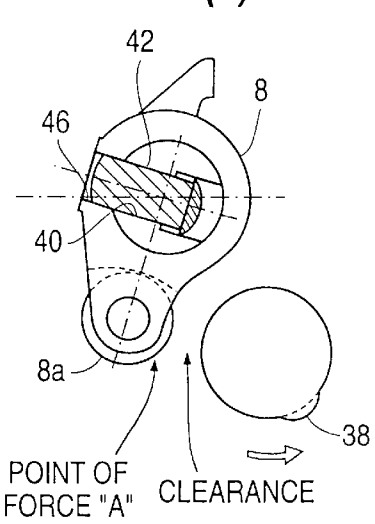
Figure 3D:
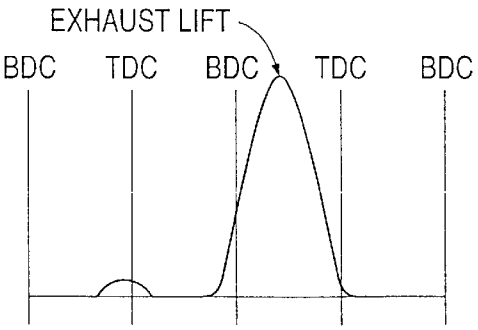

There will be next described a principal part of the valve mechanism of the internal combustion engine of the present invention. As shown in FIG. 1(*a*), the exhaust rocker arm 2, the unit injector rocker arm 4, the intake rocker arm 6 and the auxiliary engine brake rocker arm 8 are mounted on the rocker shaft 22 in this order as viewed from the left-hand end portion of the shaft 22 in this figure.

Namely, the unit injector rocker arm 4 and the intake rocker arm 6 are interposed between the exhaust rocker arm 2 and the auxiliary engine brake rocker arm 8, which means that the auxiliary engine brake rocker arm 8 is disposed at a position that is relatively largely spaced apart from the position where the exhaust rocker arm 2 is located.

Where point of force "A" shown in FIGS. 1(*a*) and 1(*c*) represents a point at which the auxiliary engine brake rocker arm 8 as the first rocker arm contacts the cam 38 (i.e., contact point between the roller 8*a* and the cam 38), and point of application B shown in FIGS. 1(*a*) and 1(*c*) represents a point at which the exhaust rocker arm 2 as the second rocker arm contacts the valve bridge 12. These points "A" and "B" are determined such that a virtual line (indicated by a two-dot chain line in FIG. 1) that connects the point "A" with the point "B" intersects with the center axis 22A of the rocker shaft 22 at a substantial middle point of the distance L between the pair of rocker shaft supports 24 disposed at the opposite ends of the rocker shaft 22.

In this connection, the point of force "A" is a point that receives, from the cam 38, the drive force for opening the exhaust valves 16 at an appropriate time other than during the normal exhaust stroke, when the auxiliary engine brake is applied (namely, when the linked mode is established in which the auxiliary engine brake rocker arm 8 operates as a unit with the rocker shaft 22 and exhaust rocker arm 2). The point of application "B" is a point to which is applied the force to open the exhaust valves 18 at this time when the rocker arm 2 is driven by the cam 38.

Thus, according to the present invention, the virtual line connecting the point of force "A" with the point of application "B" is set to intersect with the center axis of the rocker shaft 22 at a substantially middle point between the pair of the rocker shaft supports 24, so that substantially uniform force is applied to the rocker shaft supports 24 disposed at the opposite ends of the rocker shaft 22 when the auxiliary engine brake is applied and the rocker arm 2 is driven by the cam 38.

Figure 12A:
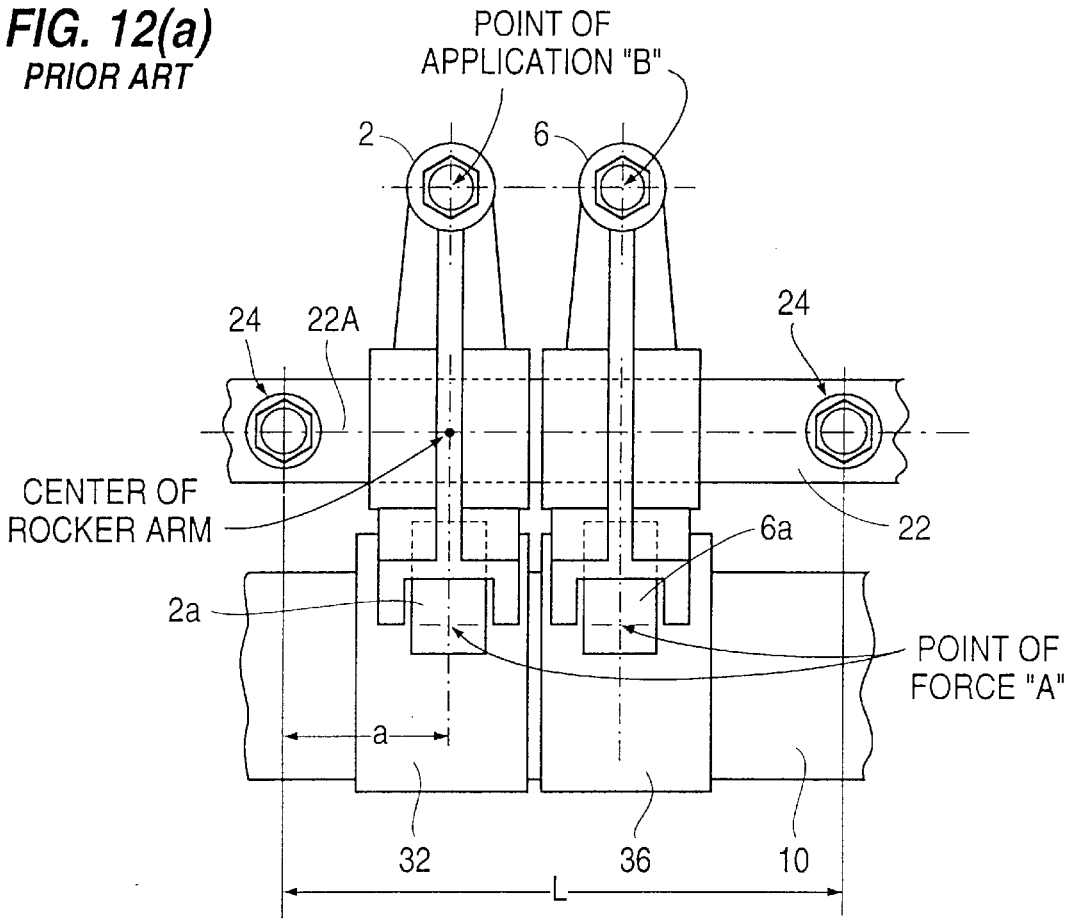
FIG. 12(a) PRIOR ART
FIG. 12(*a*) is a top plan view showing a known valve mechanism of an internal combustion engine, and FIG. 12(*b*) is a cross sectional view of the known valve mechanism.
Figure 12B:
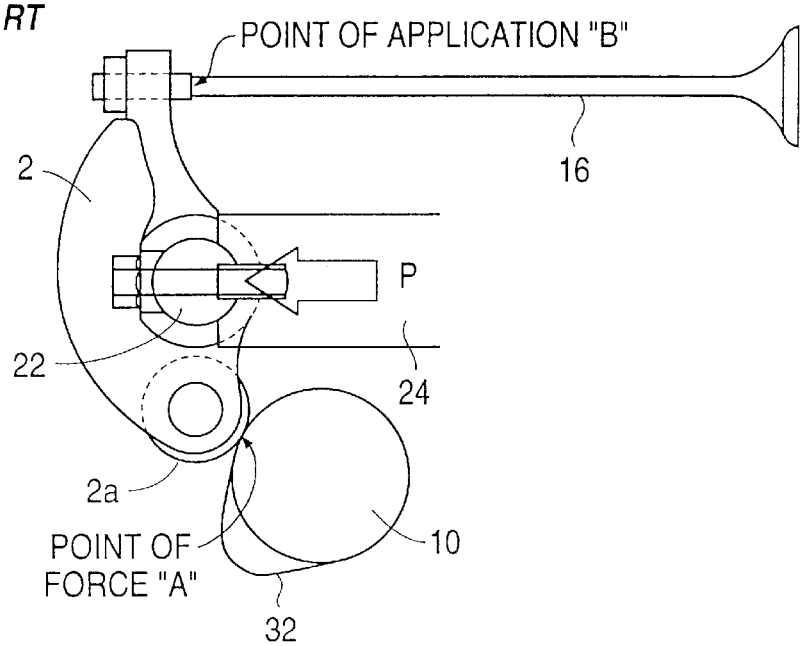
FIG. 12(b) PRIOR ART

More specifically, when the auxiliary engine brake is applied, the rocker shaft 22 receives resultant force P (refer to FIG. 12) of the bias force of valve springs (not shown) of the exhaust valves 16 and the drive force of the auxiliary engine brake cam 38 applied to the rocker arm 8. This resultant force P applied to the rocker shaft 22 can be controlled to be applied to substantially the middle point of the rocker shaft 22 by positioning the rocker arms 2, 8 such that the virtual line connecting the point of force "A" with the point of application "B" intersects with the center axis 22A at substantially the middle point of the rocker shaft 22.

The above arrangement eliminates the need to reinforce or strengthen one of the rocker shaft supports 24 as in the known valve mechanism, thereby avoiding an increase in the size of the relevant rocker shaft support 24. Consequently, the valve mechanism having a sufficiently large strength can be realized without incurring increases in the weight and cost thereof.

In the foregoing embodiment, the virtual line connecting the point of force "A" and the point of application "B" intersects with the center axis of 22A of the rocker shaft 22 substantially at the center of the axis 22A of the rocker shaft 22 between the pair of rocker shaft supports 24. The unbalance of the force, however, applied to the pair of rocker shafts can be reduced even if the virtual line does not intersect at the center of the center axis 22A as long as the point of force "A" is at the opposite side of the point of application "B" with respect to an imaginary plane, which includes the center of the axis 22A between the pair of the rocker shaft supports 24 and is orthogonal to the axis 22A.

Figure 8:
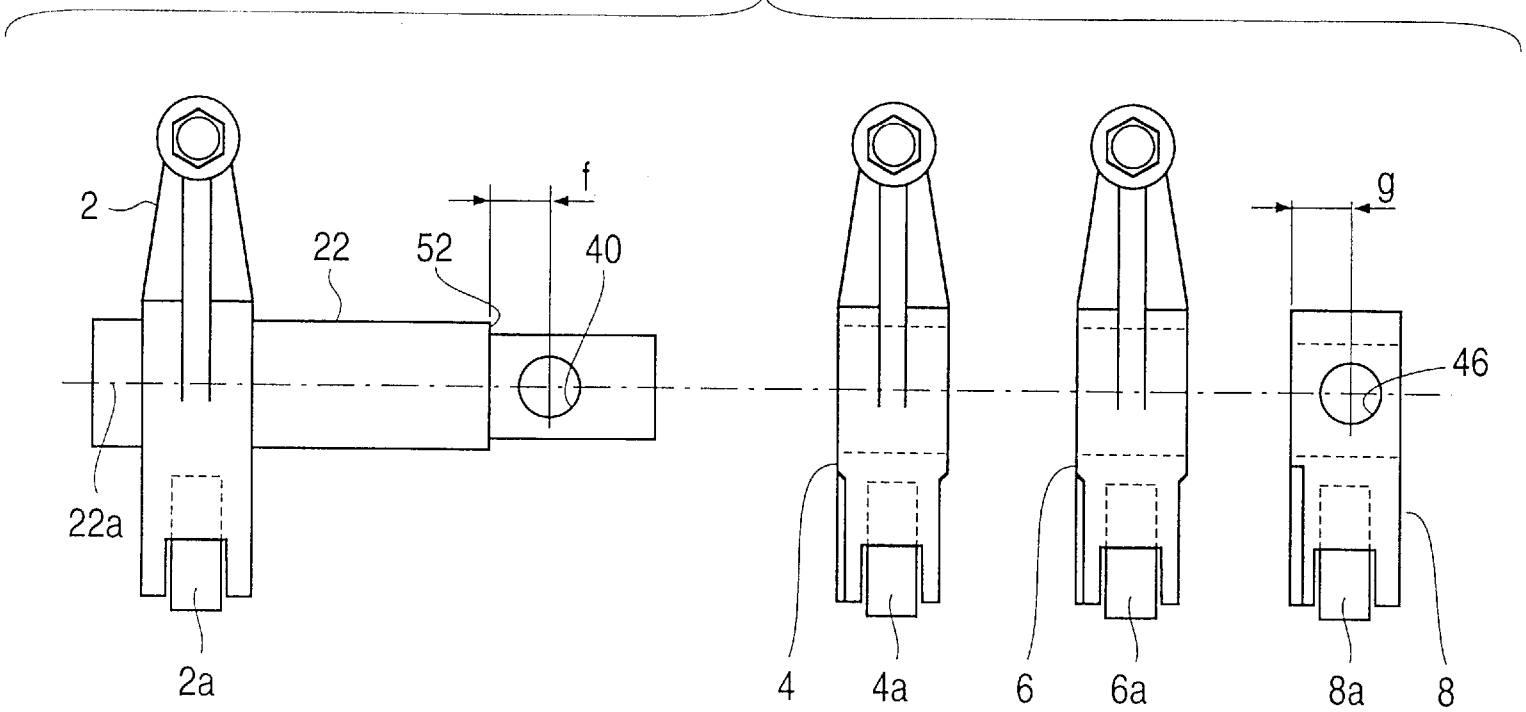
FIG. 8 is an exploded view for explaining the valve mechanism of the internal combustion engine of the first embodiment of the invention.

In the valve mechanism of the internal combustion engine of the present embodiment, a portion of the rocker shaft 22 that supports the unit injector rocker arm 4 and intake rocker arm 6 has a diameter that is different from that of a portion of the shaft 22 that supports the auxiliary engine brake rocker arm 8, as shown in FIG. 1(*a*) and FIG. 8.

Namely, the rocker shaft 22 is formed with a stepped portion 52 between its portion supporting the intake rocker arm 6 and its portion supporting the auxiliary engine brake rocker arm 8, such that the portion of the rocker shaft 22 that supports the auxiliary engine brake rocker arm 8 has a smaller diameter than the portion supporting the intake rocker arm 6.

The rocker shaft 22 is provided with the stepped portion 52 for the following reason.

With the switching mechanism 30 provided between the rocker shaft 22 and the auxiliary engine brake rocker arm 8 as described above, the engaging pin 42 received in the hole 40 of the rocker shaft 22 is brought into engagement with the engaging hole 46 of the rocker arm 8, so as to apply the auxiliary engine brake. To accurately and surely actuate this switching mechanism 30, a variation in the position between the hole 40 and the engaging hole 46 (dimensional errors of the holes 40, 46) needs to be reduced to a minimum.

Figure 13:
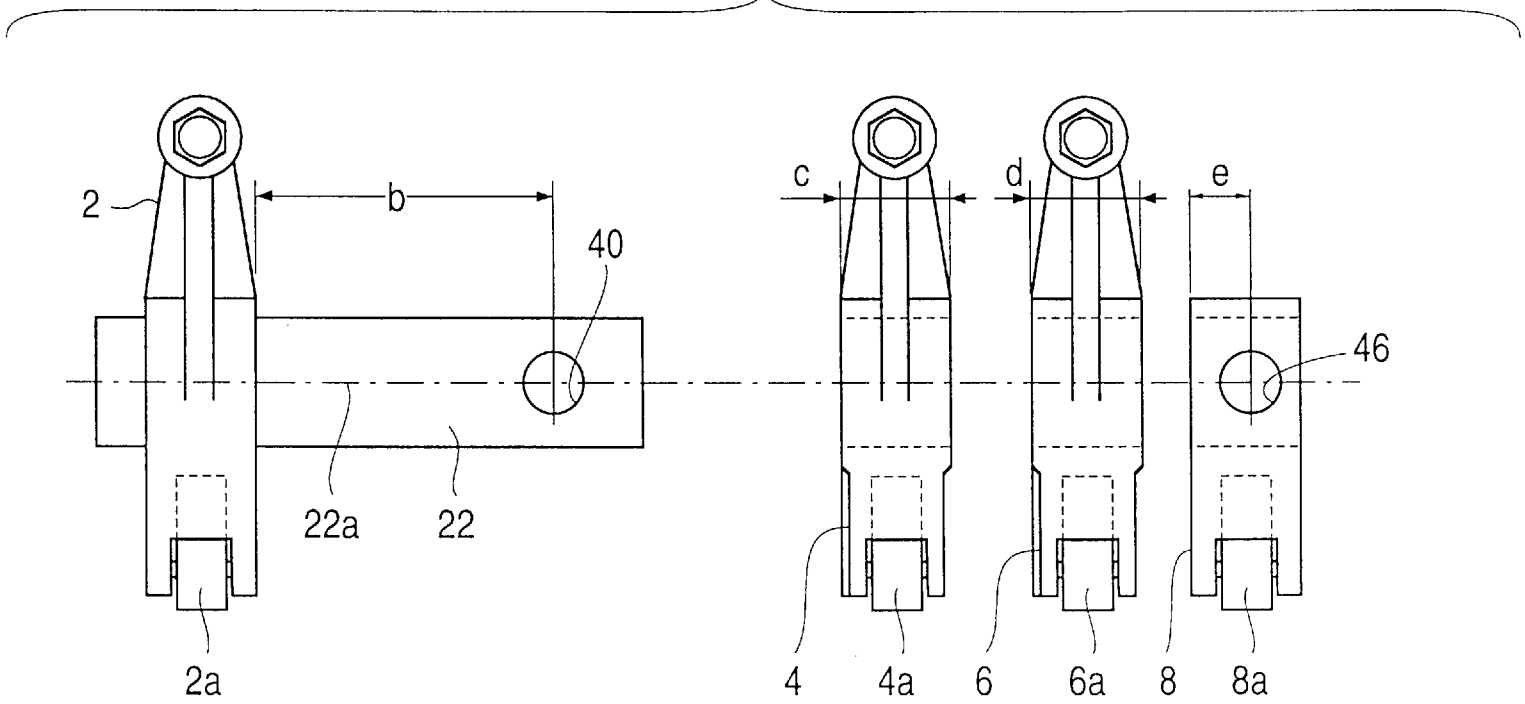
FIG. 13 PRIOR ART
FIG. 13 is an exploded view showing a general valve mechanism of an internal combustion engine.

If the rocker shaft 22 is formed with the same diameter over the entire length thereof, as shown in FIG. 13, the position of the engaging hole 46 is greatly influenced by the dimensions (as denoted by "c", "d" and "e" in FIG. 13) of the respective rocker arms 4, 6, 8 as measured in the width direction, and the position of the hole 40 is greatly influenced by the distance (as indicated by "b" in FIG. 13) between the hole 40 and the right-hand side end face (in FIG. 13) of the rocker arm 2. In this case, in particular, the variation in the position of the engaging hole 46 tends to be large due to accumulation of dimensional errors of the rocker arms 4, 6, 8 in the width direction.

To accurately align the hole 40 with the engaging hole 46, therefore, the distance "b" measured from the center of the hole 40 of the rocker shaft 22 to the end face of the rocker arm 2, and the dimensions "c", "d" and "e" of the rocker arms 4, 6, 8 need to be strictly controlled, and a difference between the distance "b" and a sum of the dimensions "c", "d" and "e" needs to be reduced to be within a predetermined value. Such strict controls may induce an undesirable increase in the manufacturing cost.

It may be considered to make the inside diameter of the engaging hole 46 apparently larger than the diameter of the engaging pin 42 to ensure that the engaging pin 42 is inserted into the engaging hole 46. In this case, however, there arises a large clearance between the engaging hole 46 and the engaging pin 42, making it impossible to accurately operate the exhaust rocker arm 2 in accordance with the cam profile of the auxiliary engine brake cam 38.

In view of the above, in the valve mechanism of the present embodiment, the rocker shaft 22 is provided with the stepped portion 52, as shown in FIG. 8, such that the engaging hole 46 of the rocker arm 8 is positioned on the basis of the stepped portion 52.

With the stepped portion 52 formed on the rocker shaft 22 as described above, the rocker shaft 22 includes a large-diameter portion that supports the rocker arms 4, 6, and a small-diameter portion that supports the rocker arm 8. This enables the center position of the hole 40 of the rocker shaft 22 to be adjusted by controlling a relatively short distance "f" measured from the stepped portion 52 of the rocker shaft 22. Further, the position of the engaging hole 46 of the rocker arm 8 can be adjusted by controlling a relatively short distance "g" measured from the side face of the arm 8 that contacts the stepped portion 52 of the rocker shaft 22.

In the above arrangement, the positions of the hole 40 and the engaging hole 46 can be relatively easily adjusted or controlled with high accuracy, thus ensuring smooth engagement of the engaging pin 42 with the engaging hole 46 when the switching mechanism 30 establishes the linked mode as described above.

In particular, the dimensional accuracy of the hole 40 and engaging hole 46 is governed only by the distances "f" and "g" from the side face of the rocker arm 8, and is thus free from influences of dimensional errors of the other rocker arms 4, 6. Thus, the position of the hole 40 and engaging hole 46 can be easily controlled with high accuracy.

In the valve mechanism of the internal combustion engine of the first embodiment of the present invention constructed as described above, the switching mechanism 30 is placed in the non-linked mode when the engine 1 is in the positive power mode, namely, when the auxiliary engine brake is not applied. In this mode, the hydraulic fluid is not supplied to the hydraulic fluid supply path 50, and the engaging pin 42 is entirely received within the hole 40 of the rocker shaft 22 by the bias force of the return spring 44, as shown in FIG. 1(*c*). In this condition, the auxiliary engine brake rocker arm 8 is separated or dissociated from the rocker shaft 22, and does not move along with the exhaust rocker arm 2.

Namely, even when the exhaust rocker arm 2 is driven by the exhaust cam 32 as shown in FIG. 1(*b*), the auxiliary engine brake rocker arm 8 operates according to the profile of the cam 38, independently of the movement of the exhaust rocker arm 2, as shown in FIG. 1(*c*).

As a result, the exhaust valves 18 are driven by the exhaust rocker arm 2, and are opened and closed in a valve timing suitable for the normal engine operation (positive power mode), as shown in the valve-lift timing chart of FIG. 1(*d*). The intake valves 18 are also opened and closed by the intake rocker arm 6 in a normal valve-lift timing.

When the auxiliary engine braking is effected, on the other hand, the switching mechanism 30 is operated to the linked mode. In this mode, the hydraulic fluid having a predetermined pressure is supplied from the hydraulic supply system to the space 48 shown in FIG. 4(*b*) through the hydraulic fluid supply path 50 shown in FIG. 2(*a*), so that the engaging pin 42 is lifted against the bias force of the return spring 44.

As a result, the engaging pin 42 engages the engaging hole 46 of the auxiliary engine brake rocker arm 8, and this rocker arm 8 is caused to operate or move as a unit with the exhaust rocker arm 2 formed integrally with the rocker shaft 22.

When the auxiliary engine brake rocker arm 8 is driven by the auxiliary engine brake cam 38, therefore, the exhaust rocker arm 2 is also driven, as shown in FIG. 2(*d*), so as to open the exhaust valves 16.

As described above, the profile of the auxiliary engine brake cam 38 is designed such that the cam 38 swings or rocks the auxiliary engine brake rocker arm 8 when the piston 20 reaches near the top dead center of the compression stroke. Thus, the exhaust valves 16 are opened only by a given amount when the piston 20 is near the top dead center of the compression stroke, as shown in the valve-lift timing chart of FIG. 2(*d*), so as to release the compressed air and cause the engine 1 to perform negative work.

Even when the auxiliary engine brake is applied, the exhaust valves 16 are driven by the exhaust cam 32 during the exhaust stroke of the engine 1 as in the positive power mode, as shown in FIG. 3(*b*). At this time, the auxiliary engine brake rocker arm 8 is driven in association with the exhaust rocker arm 2, whereby a clearance appears between the rocker arm 8 and the cam 38, as shown in FIG. 3(*c*).

In FIG. 3(*a*), the exhaust rocker arm 2, rocker shaft 22 and auxiliary engine brake rocker arm 8 are shown as in FIG. 2(*a*), but the other rocker arms 4, 6 are omitted. FIG. 3(*d*) is a valve-lift timing chart that is identical with that shown in FIG. 2(*d*), showing a valve lift characteristic when the auxiliary engine brake is applied.

In the valve mechanism of the internal combustion engine of the present invention, the virtual line (indicated by a two-dot chain line in FIG. 1(*a*)) connecting the point of force "A" at one end of the auxiliary engine brake rocker arm 8 and the point of application "B" at one end of the exhaust rocker arm 2 is set to intersect with the center axis 22A of the rocker shaft 22 at substantially the middle point of the distance L between the pair of the rocker shaft supports 24. Upon application of the auxiliary engine brake, therefore, the resultant force P, which is a sum of the drive force applied from the auxiliary engine brake cam 38 to the point of force "A" and the force applied to the point of application "B" due to the bias force of the valve springs (not shown) of the exhaust valves 16, is applied to the approximately middle point between the pair of the rocker shaft supports 24 disposed at the opposite ends of the rocker shaft 22.

Accordingly, substantially half of the resultant force P is evenly applied to each of the rocker shaft supports 24, whereby the burden on one of the rocker shaft supports 24 does not become larger than that on the other support 24. This eliminates a need to reinforce one of the rocker shaft supports 24 as in the known valve mechanism, avoiding an increase in the size of the rocker shaft support 24. Thus, the present valve mechanism having a sufficiently high mechanical strength can be obtained without incurring increases in weight and cost.

The drive force applied from the cam 32 to the exhaust rocker arm 2, the drive force applied from the cam 34 to the unit injector rocker arm 4 and the drive force applied from the cam 36 to the intake rocker arm 6 are not necessarily applied to the middle part of the rocker shaft 22. Although the load resulting from these drive forces is not evenly distributed to the two rocker shaft supports 24, this does not cause a substantial problem since the above drive forces are significantly smaller than the drive force with which the exhaust rocker arm 2 is driven by the auxiliary engine brake cam 38.

In the valve mechanism of the present embodiment, the rocker shaft 22 is formed with the stepped portion 52, as shown in FIG. 8, so that the position of the engaging hole 46 of the rocker arm 8 is determined using the stepped portion 52 as a reference point. Namely, the center position of the hole 40 of the rocker shaft 22 can be adjusted by controlling the relatively small distance "f" measured from the stepped portion 52 of the rocker shaft 22, and the position of the engaging hole 46 of the rocker arm 8 can be also adjusted by controlling the relative short distance "g" measured from the side face of the rocker arm 8 that contacts the stepped portion 52.

Thus, the dimensional accuracy (relative position) of the hole 40 and engaging hole 46 can be relatively easily controlled, so as to ensure that the engaging pin 42 engages the engaging hole 46 when the switching mechanism 30 establishes the linked mode in which the rocker arm 8 is linked with the rocker shaft 22.

In particular, the center position of the engaging hole 46 can be easily adjusted based only on the distance "g" from the side face of the rocker arm 8, without being influenced by dimensional errors of the other rocker arms 4, 6.

Figure 9A:
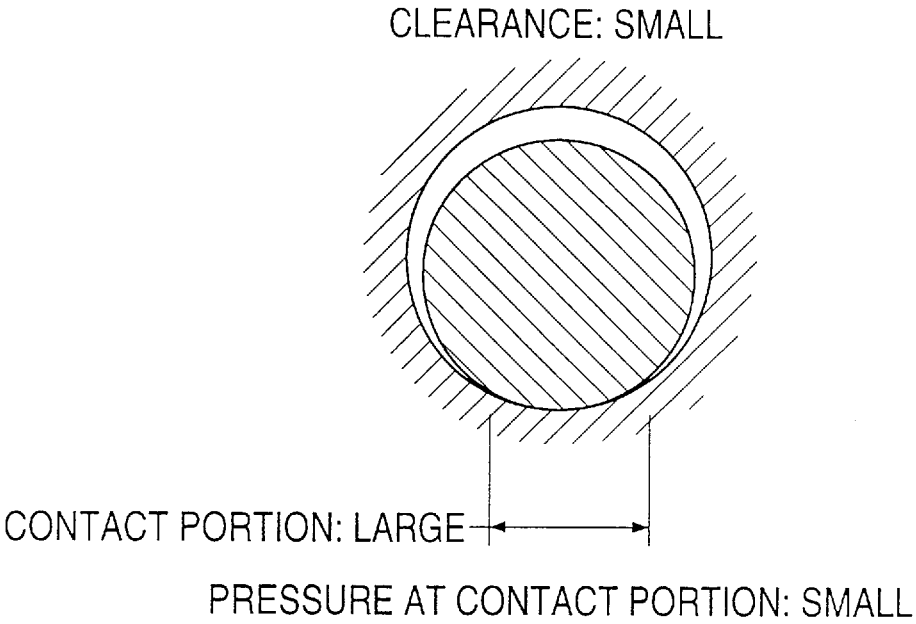
FIGS. 9(*a*) and 9(*b*) are views for explaining the operation of the valve mechanism of the internal combustion engine of the first embodiment of the invention.
Figure 9B:
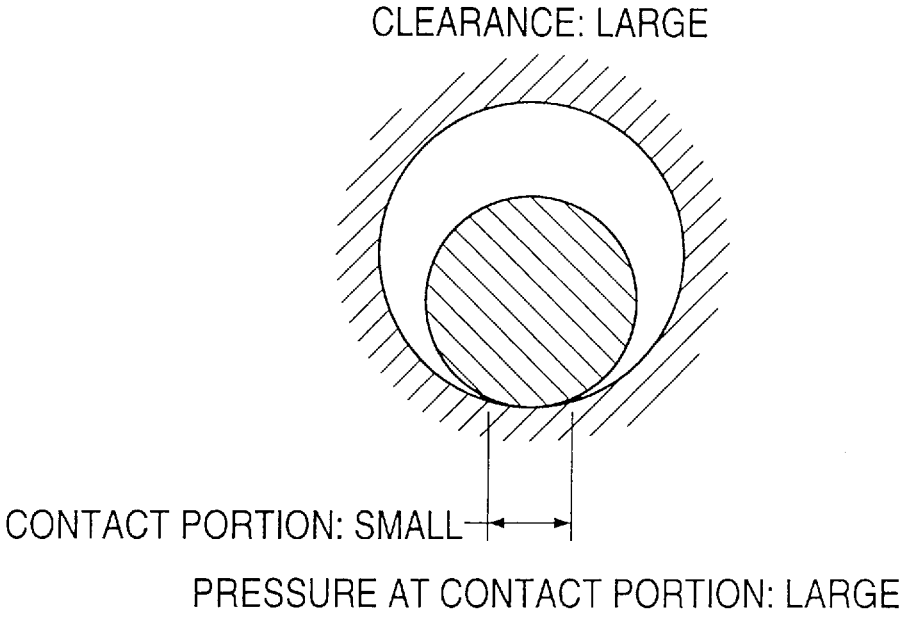

Since the hole 40 is aligned with the hole 46 with high accuracy in the above-described manner, the clearance between the hole 46 of the rocker arm 8 and the engaging pin 42 can be reduced, and the pressure measured at contact portions of the rocker arm 8 and engaging pin 42 can be reduced, as shown in FIG. 9(*a*) and FIG. 9(*b*). Accordingly, the durability, mainly wear resistance, of the rocker arm 8 can be advantageously improved.

In the foregoing embodiment, the rocker shaft 22 can be formed integrally with the rocker arm 8 and rotatably support the rocker arm 2. Further, the hole 40 for protruding and retracting the engaging pin can be formed at a portion of the rocker shaft 22 where the rocker shaft 22 supports the rocker arm 2, and the engaging hole 46, engageable with the engaging pin 42, can be formed on the rocker arm 2.

There will be next described a valve mechanism of an internal combustion engine of the second embodiment of the present invention. In this valve mechanism of the engine 1, exhaust rocker arm 2 and intake rocker arm 6 are supported by a rocker shaft 22 about its axis, as shown in FIG. 10.

The engine 1 of this embodiment is not equipped with an auxiliary engine brake system and a unit injector as explained above with respect to the first embodiment, and the intake and exhaust valves 18, 16 (as shown in FIG. 5) are operated by respective rocker arms 6, 2.

The rocker shaft 22 is supported at its opposite ends by a pair of rocker shaft supports 24, and the intake rocker arm 6 is supported on the rocker shaft 22 at an approximately middle point of the distance L between these two rocker shaft supports 24.

Figure 10:
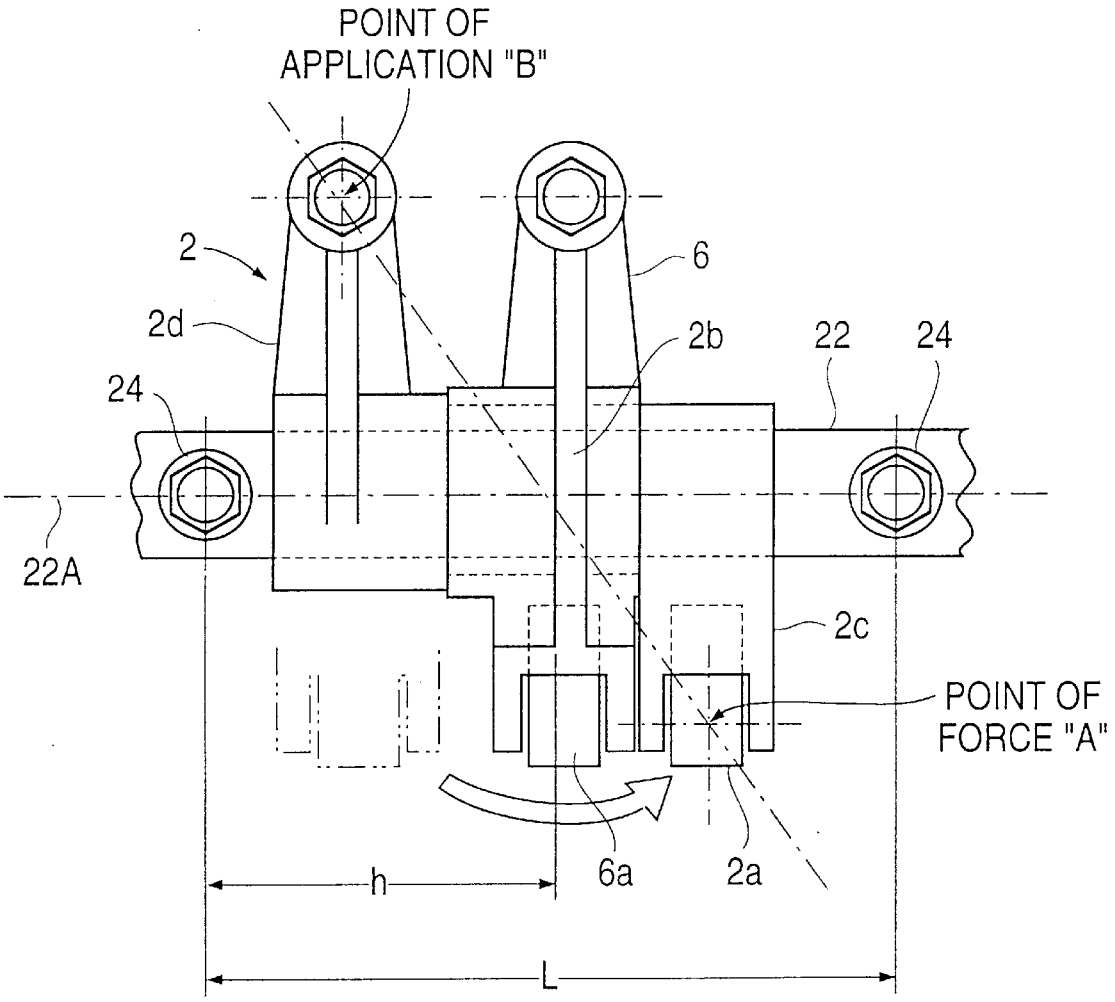
FIG. 10 is a schematic view showing a valve mechanism of an internal combustion engine of the second embodiment of the present invention.

On the other hand, the exhaust rocker arm 2 is disposed adjacent to the intake rocker arm 6, as shown in FIG. 10. This exhaust rocker arm 2 is formed with a sleeve-like axial portion 2*b* that extends in the direction of the center axis 22A of the rocker shaft 22, and the exhaust rocker arm 2 is supported by the rocker shaft 22 about its axis such that the rocker shaft 22 extends through this axial portion 2*b*. The intake rocker arm 6 is rotatably supported by the rocker shaft 22 about its axis through the axial portion 2*b* of the exhaust rocker arm 2.

The exhaust rocker arm 2 further includes an arm portion 2*c* which is connected to one end (right-hand end in FIG. 10) of the axial portion 2*b* and which abuts on the exhaust cam 32 (refer to FIG. 5), as well as an arm portion 2*d* connected to the other end of the axial portion 2*b* and disposed on the side of exhaust valves 16. Thus, the exhaust rocker arm 2 is formed such that the intake rocker arm 6 is interposed between the arm portion 2*d* on the side of the exhaust valves 16 and the arm portion 2*c* on the side of the exhaust cam 32.

The point of force "A," shown in FIG. 10, represents a point at the distal end of the arm portion 2*c* of the exhaust cam 32 which receives the drive force from the exhaust cam 32, and the point of application "B" represents a point at the distal end of the arm portion 2*d* on the side of the exhaust valves 16 which transmits the drive force from the cam 32 to the exhaust valves 16. A virtual line (indicated by a two-dot chain line in FIG. 10) that connects the point A with the point B intersects with the center axis 22A of the rocker shaft 22 at a substantially middle point of the distance L between the pair of rocker shaft supports 24.

Namely, the above-described virtual line intersects with the center axis 22A at its position that is spaced a distance "h" from the left rocker shaft support 24, as shown in FIG. 10, and this distance "h" is set to be approximately half of the distance L between the two rocker shaft supports 24.

The second embodiment is constructed similarly to the first embodiment except for the above-described aspects, and the common or similar features in the construction will not be explained herein. The same reference numerals as used in the description of the first embodiment are used in FIG. 10 to identify structurally corresponding elements, some of which are not explained in detail.

With the valve mechanism of the internal combustion engine of the second embodiment of the present invention constructed as described above, when the intake rocker arm 6 is driven by the intake cam 36, the load is applied from the intake rocker arm 6 to a substantially middle part of the rocker shaft 22, since the intake rocker arm 6 is disposed substantially in the middle of the rocker shaft 22. Consequently, about half of the load from the intake rocker arm 6 is evenly applied to each of the pair of rocker shaft supports 24.

When the exhaust rocker arm 2 is driven, on the other hand, the drive force is applied from the exhaust cam 32 to the point of force "A", and the exhaust valves 16 are driven at the point of application "B". At this time, the load is applied from the exhaust rocker arm 2 to a substantially middle part of the rocker shaft 22 since the virtual line connecting the point A with the point B intersects with the rocker shaft axis 22A at an approximately middle point thereof between the pair of rocker shaft supports 24.

Thus, even when the exhaust rocker arm 2 is operated, about half of the load from the exhaust rocker arm 2 is evenly applied to each of the pair of rocker shaft supports 24. This eliminates a need to reinforce one of the rocker shaft supports 24 as in the known valve mechanism, thereby avoiding an increase in the size of the rocker shaft support 24. Thus, the present valve mechanism employs a small-sized, light-weight valve system, and still assures a sufficiently high mechanical strength.

Figure 11:
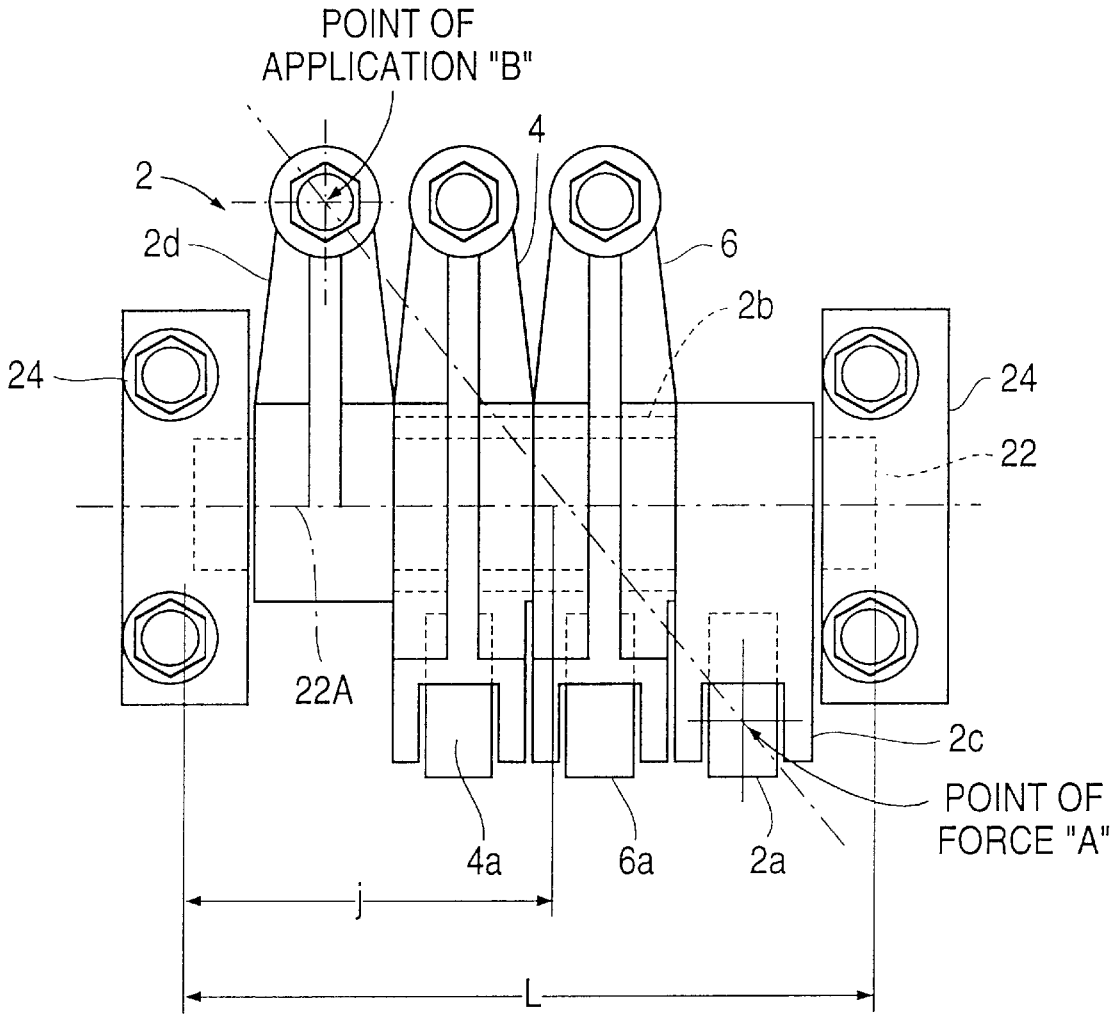
FIG. 11 is a schematic view showing a valve mechanism of an internal combustion engine of the third embodiment of the present invention.

There will be next described a valve mechanism of an internal combustion engine of the third embodiment of the present invention. As shown in FIG. 11, this embodiment is constructed substantially similarly to the second embodiment as described above.

In the valve mechanism of the engine 1, exhaust rocker arm 2 and intake rocker arm 6 are supported by rocker shaft 22 about its axis, and the intake and exhaust valves 18, 16 (refer to FIG. 5) are respectively driven by these intake and exhaust rocker arms 6, 2.

The engine 1 is not equipped with an auxiliary engine brake system, as described above with respect to the first embodiment, and the exhaust rocker arm 2 operates in a normal exhaust timing so as to open and close the exhaust valves 16.

The engine 1 of the present embodiment is equipped with a fuel injection pump (unit injector), and a unit injector rocker arm 4 for driving this unit injector is supported by the rocker shaft 22 about its axis.

The rocker shaft 22 is supported at its opposite ends by a pair of rocker shaft supports 24, and the unit injector rocker arm 4 and the intake rocker arm 6 are provided in a substantially middle part of the distance L between these two rocker shaft supports 24.

The exhaust rocker arm 2 is formed with a sleeve-like axial portion 2*b* that extends in the direction of the center axis 22A of the rocker shaft 22, and the exhaust rocker arm 2 is rotatably supported by the rocker shaft 22 such that the arm 2 rotates about the axis of the rocker shaft 22. As illustrated in FIG. 11, the shaft 22 extends through this sleeve-like axial portion 2*b*.

The unit injector rocker arm 4 and the intake rocker arm 6 are rotatably supported by the rocker shaft 22 through the axial portion 2*b* of the exhaust rocker arm 2 such that the arm 4 rotates about the axis of the rocker shaft 22.

The exhaust rocker arm 2 further includes an arm portion 2*c* which is connected to one end (right-hand end in FIG. 11)

of the axial portion 2*b* and which abuts on the exhaust cam 32 (refer to FIG. 5), as well as an arm portion 2*d* connected to the other end of the axial portion 2*b* and disposed on the side of the exhaust valves 16. Thus, the exhaust rocker arm 2 is formed such that the unit injector rocker arm 4 and the intake rocker arm 6 are interposed between the arm portion 2*d* on the side of the exhaust valves 16 and the arm portion 2*c* on the side of the exhaust cam 32.

Where point of force "A" shown in FIG. 11 located at the distal end of the arm portion 2*c* of the exhaust rocker arm 2 represents a point which receives the drive force from the exhaust cam 32, and point of application "B" located at the distal end of the arm portion 2*d* on the side of the exhaust valves 16 represents a point at which the drive force from the cam 32 is transmitted to the exhaust valves 16, a virtual line (indicated by a two-dot chain line in FIG. 11) that connects the point A with the point B intersects with the center axis 22A of the rocker shaft 22 at a substantially middle point of the distance L between the pair of rocker shaft supports 24.

Namely, the above-described virtual line intersects with the center axis 22A at its position that is spaced a distance "j" from the left rocker shaft support 24 as shown in FIG. 11, and this distance "j" is set to be about half of the distance L between the two rocker shaft supports 24 disposed at the opposite ends of the rocker shaft 22.

The third embodiment is constructed similarly to the first embodiment except for the above-described aspects, and the common or similar features in the construction will not be explained herein. The same reference numerals as used in the description of the first embodiment are used in FIG. 11 to identify structurally corresponding elements, some of which are not explained in detail.

With the valve mechanism in the internal combustion engine of the third embodiment of the invention constructed as described above, the load that results upon driving of the unit injector rocker arm 4 and the intake rocker arm 6 is applied to a substantially middle part of the rocker shaft 22.

Namely, since the unit injector rocker arm 4 and intake rocker arm 7 are disposed substantially in the middle of the rocker shaft 22, the load applied by these rocker arms 4, 6 acts on a substantially middle part of the rocker shaft 22. Accordingly, about half of the load from the unit injector rocker arm 4 or intake rocker arm 6 is evenly applied to each of the pair of rocker shaft supports 24.

When the exhaust rocker arm 2 is driven, on the other hand, the drive force is applied from the exhaust cam 32 to the point of force "A", and the exhaust valves 16 are driven at the point of application "B". At this time, the load is applied from the exhaust rocker arm 2 to a substantially middle part of the rocker shaft 22 as in the second embodiment since the virtual line connecting the point A with the point B intersects with the rocker shaft axis 22A at an approximately middle point thereof between the pair of rocker shaft supports 24.

The above arrangement eliminates a need to reinforce one of the rocker shaft supports 24 as in the known valve mechanism, thus avoiding an increase in the size of the rocker shaft support 24. Thus, the present valve mechanism employs a small-sized, light-weight valve system, and still assures a sufficiently high mechanical strength.

While the auxiliary engine brake rocker arm, the exhaust rocker arm and the intake rocker arm are respectively used as the first, second and third rocker arms in the first embodiment as described above, a rocker arm for switching high-speed and low-speed operations of the engine, the intake rocker arm, and the exhaust rocker arm may be used as the first, second and third rocker arms, respectively. In this modified valve mechanism, the valve timing and the lift amount of the intake valves can be varied in two steps according to the profile of a cam that drives the rocker arm for switching high-speed and low-speed engine operations.

In the above case, the cam that contacts a point of force of the first rocker arm is preferably designed for the high-speed engine operation, and the cam that contacts a point of force of the second rocker arm is preferably designed for the low-speed operation. In this arrangement, the intake valves are opened and closed according to the profile of the low-speed cam while the vehicle is in a low-speed range, and opened according to the profile of the high-speed cam while the vehicle is in a high-speed range, thus assuring high performance of the engine.

The present invention is suitably applied to valve mechanisms in which rocker arms, such as intake rocker arm and exhaust rocker arm of the same cylinder, which operate in different timings are supported on the same rocker shaft.

Where intake rocker arms or exhaust rocker arms of the same cylinder cannot be evenly or uniformly provided between rocker shaft supports due to a limit in designs to the location of intake valves and exhaust valves within a combustion chamber, the middle point of the rocker arms of each kind may be set to be approximately in the middle of the rocker shaft supports, so as to yield substantially the same effects as provided by the above-described embodiments.

While the present invention is applied to diesel engines in the illustrated embodiments, it is to be understood that the present invention is not limited to the diesel engines but may be similarly applied to gasoline engines equipped with ignition plugs.

Further, the valve opening system of the present invention can also be used in Over Head Valve (OHV) type engines in which rocker arms are driven by a camshaft through push rods.

What is claimed is:

1. A valve operating mechanism of an internal combustion engine, comprising:

a rocker shaft supported at opposite end portions thereof by a pair of rocker shaft supports onto a cylinder head;

a first rocker arm supported by said rocker shaft and located between said rocker shaft supports, said first rocker arm having at one end portion thereof a point of force that receives drive force from a camshaft;

a second rocker arm supported by said rocker shaft at a position offset from said first rocker arm in a direction of an axis of said rocker shaft, said second rocker arm being movable with said first rocker arm and having at an end portion thereof a point of application for driving at least one poppet valve, said second rocker arm end portion being located opposite to said point of force of said first rocker arm with respect to the axis of said rocker shaft, and said first and second rocker arms being offset such that an imaginary plane, interposed between the point of application and the point of force, intersects substantially at a middle point of said rocker shaft between said rocker shaft supports; and at least one third rocker arm supported by said rocker shaft between said first rocker arm and said second rocker arm, said third rocker arm having a point of force at one end portion thereof which receives the drive force from said camshaft, and a point of application at the other end portion thereof which drives at least one other poppet valve.

2. A valve operating mechanism of an internal combustion engine according to claim 1, wherein a virtual line connecting said point of force of said first rocker arm with said point of application of said second rocker arm intersects with said axis of said rocker shaft at a substantially middle point of the rocker shaft between said rocker shaft supports.

3. A valve operating mechanism of an internal combustion engine according to claim 1, wherein said first rocker arm is a rocker arm for switching high-speed and low-speed operations of the engine, wherein said second rocker arm is an intake rocker arm, and wherein said third rocker arm is an exhaust rocker arm.

4. A valve operating mechanism of an internal combustion engine according to claim 1, wherein said third rocker arm is supported by said rocker shaft at a substantially middle point of the rocker shaft between said rocker shaft supports.

5. A valve operating mechanism of an internal combustion engine according to claim 1, wherein said at least one poppet valve driven by said second rocker arm is an exhaust valve, and at least one other poppet valve that is driven by said third rocker arm is an intake valve.

6. A valve operating mechanism of an internal combustion engine according to claim 5, further comprising:

a fourth rocker arm provided between said first and second rocker arms for driving a fuel injection valve.

7. A valve operating mechanism of an internal combustion engine according to claim 1, wherein said second rocker arm is moved with said first rocker arm through a linking mechanism engageable with said first rocker arm, and said second rocker arm has a point of force to which the drive force is applied from said camshaft in a different timing from that in which said point of force of said first rocker arm receives the drive force, said point of force of the second rocker arm being located in an end portion thereof opposite to said end portion in which said point of application is located.

8. A valve operating mechanism of an internal combustion engine according to claim 7, wherein said poppet valves include at least one exhaust valve driven by said second rocker arm, said first rocker arm being driven by said camshaft to open said at least one exhaust valve at a point of a compression stroke close to a top dead center.

9. A valve operating mechanism of an internal combustion engine according to claim 7, wherein said rocker shaft is rotatably supported by said pair of rocker shaft supports, and one of said first and second rocker arms is pivoted as a unit with said rocker shaft while the other of the first and second rocker arms is rotatably supported by said rocker shaft, and wherein said linking mechanism has an engaging pin that is movably received in a hole formed in said rocker shaft, and an engaging hole that is formed in the other of the first and second rocker arms such that said engaging pin is selectively engageable with said engaging hole.

10. A valve operating mechanism of an internal combustion engine according to claim 9, wherein said rocker shaft has a first portion on which the other of the first and second rocker arms is rotatably supported, and a second portion on which said at least one third rocker arm is rotatably supported, said first portion of the rocker shaft having a smaller diameter than said second portion, said first and second portions defining a boundary portion with an end face of the second portion which determines a position of the other of the first and second rocker arms in a direction of the axis of said rocker shaft.

11. A valve operating mechanism of an internal combustion engine according to claim 3, wherein a first cam which contacts said point of force of said first rocker arm is designed for a high-speed engine operation, and wherein a second cam which contacts said point of force of said second rocker arm is designed for a low-speed engine operation.

12. A valve operating mechanism of an internal combustion engine, comprising:

a rocker shaft rotatably supported by a cylinder head;

a first rocker arm supported by said rocker shaft and having a point of force that receives drive force from a camshaft;

a second rocker arm supported by said rocker shaft at a position offset from said first rocker arm, in a direction of an axis of said rocker shaft, said second rocker arm being movable with said first rocker arm through a linking mechanism that is engageable with the first rocker arm, said second rocker arm having a point of application that drives at least one poppet valve at an end portion thereof opposite to said point of force of said first rocker arm with respect to the axis of said rocker shaft; and a third rocker arm supported by said rocker shaft to be located between said first and second rocker arms, said third rocker arm having a point of force that receives the drive force from said camshaft at one end portion thereof, and a point of application that drives at least one other poppet valve at the other end portion thereof; wherein said second rocker arm has a point of force at an end portion thereof opposite to said end portion having said point of application, said point of force of said second rocker arm receiving the drive force from said cam shaft in a different timing from that in which said point of force of said first rocker arm receives the drive force; wherein one of said first rocker arm and said second rocker arm is pivoted as a unit with said camshaft, while the other of the first and second rocker arms is rotatably supported by said rocker shaft, said linking mechanism includes an engaging pin movably received in a hole formed in said rocker shaft, and an engaging hole that is formed in the other of the first and second rocker arms such that said engaging pin is engageable with said engaging hole, and wherein said rocker shaft has a first portion on which the other of the first and second rocker arms is rotatably supported and a second portion on which said third rocker arm is rotatably supported, said first portion having a smaller diameter than said second portion, said first and second portions defining a boundary portion with an end face of the second portion which determines a position of the other of the first and second rocker arms in a direction of the axis of said rocker shaft.

* * * * *